US009249958B2

(12) United States Patent
Schmuckle

(10) Patent No.: US 9,249,958 B2
(45) Date of Patent: Feb. 2, 2016

(54) LIGHT FIXTURES WITH TWIST AND LOCK MOUNTING BRACKET ASSEMBLY

(71) Applicant: Darrin I. Schmuckle, Vista, CA (US)

(72) Inventor: Darrin I. Schmuckle, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 525 days.

(21) Appl. No.: 13/717,379

(22) Filed: Dec. 17, 2012

(65) Prior Publication Data

US 2013/0208489 A1 Aug. 15, 2013

Related U.S. Application Data

(63) Continuation-in-part of application No. 13/396,427, filed on Feb. 14, 2012, now Pat. No. 8,939,600.

(51) Int. Cl.

| | |
|---|---|
| ***F21V 9/08*** | (2006.01) |
| ***F21V 21/02*** | (2006.01) |
| ***F21K 99/00*** | (2010.01) |
| ***F21V 21/03*** | (2006.01) |
| ***F21V 21/30*** | (2006.01) |
| ***F21V 29/76*** | (2015.01) |
| *F21V 27/02* | (2006.01) |
| *F21V 31/00* | (2006.01) |
| *F21Y 101/02* | (2006.01) |

(52) U.S. Cl.
CPC . *F21V 21/02* (2013.01); *F21K 9/30* (2013.01); *F21V 21/03* (2013.01); *F21V 21/30* (2013.01); *F21V 29/767* (2015.01); *F21V 27/02* (2013.01); *F21V 31/005* (2013.01); *F21Y 2101/02* (2013.01)

(58) Field of Classification Search
CPC ..... F21W 2111/02; F21W 2131/107; F21V 21/03; F21V 9/08; F21K 9/30; F21Y 2101/02
See application file for complete search history.

(56) References Cited

U.S. PATENT DOCUMENTS

| | | | | |
|---|---|---|---|---|
| 3,524,981 | A * | 8/1970 | Auerbach | 362/433 |
| 6,612,720 | B1 | 9/2003 | Beadle et al. | |
| 6,779,907 | B2 | 8/2004 | Beadle et al. | |
| 6,874,905 | B1 | 4/2005 | Beadle et al. | |
| 6,902,200 | B1 | 6/2005 | Beadle et al. | |
| 7,226,189 | B2 * | 6/2007 | Lee et al. | 362/294 |
| 7,387,409 | B1 | 6/2008 | Beadle et al. | |
| 7,874,709 | B1 | 1/2011 | Beadle et al. | |

* cited by examiner

*Primary Examiner* — Ismael Negron
(74) *Attorney, Agent, or Firm* — Knobbe, Martens, Olson & Bear, LLP

(57) ABSTRACT

LED light fixtures include a hollow body, a source of illumination mounted inside the body, a transparent cover extending across one end of the body, and a twist and lock mounting bracket assembly provided at another end of the body for securing the light fixtures to a building structure.

14 Claims, 13 Drawing Sheets

LIGHT FIXTURES WITH TWIST AND LOCK MOUNTING BRACKET ASSEMBLY

CROSS-REFERENCE TO RELATED APPLICATION

This application is a continuation-in-part of pending U.S. Ser. No. 13/396,427 filed by Joshua Beadle et al. on Feb. 14, 2012 and entitled "Landscape Down Light Fixture Configured for Water Drainage." The entire disclosure of the aforementioned application is hereby incorporated by reference.

FIELD OF THE INVENTION

The present invention relates to light fixtures, and more particularly, incandescent and LED light fixtures designed for installation on building structures and on other structures located around lawns and gardens of residential and commercial properties.

BACKGROUND OF THE INVENTION

Outdoor landscape lighting is popular for security, aesthetic, safety, and other reasons. For many years outdoor landscape light fixtures have incorporated incandescent light bulbs. Recent advances in light emitting diode (LED) technology have led to an increased demand for improved landscape light fixtures that utilize more reliable and more energy efficient high intensity LEDs.

Various types of commercial landscape light fixtures are available to meet the particular needs of residential or commercial properties. These include path, down, deck, tree, spot, spread, and security light fixtures. Down light fixtures, also referred to as "downlighting" or "moonlighting", are outdoor landscape light fixtures that are designed to place the illuminating source above the target area. Down light fixtures can be used to illuminate specific garden elements for aesthetic appeal, or to illuminate pedestrian areas and large specific spaces for safety, security or recreational purposes.

Outdoor landscape light fixtures are exposed to rainfall and, not infrequently, to water sprayed by irrigation systems. Down light fixtures, as the name suggests, are pointed downwardly, and therefore have special waterproofing issues.

In the past the mounting of outdoor landscape light fixtures on the sides of building structures such as dwelling sidewalls, patio trellis beams, and decorative posts has usually been accomplished using wood screws. Typically these light fixtures have utilized integral brackets making the mounting process tedious. Moreover, repair or replacement of such light fixtures has usually required detachment of the mounting brackets from the structures.

SUMMARY OF THE INVENTION

In accordance with the present invention, a light fixture is provided for installation on building structures and on other structures located around lawns and gardens of residential and commercial properties. The light fixture includes a body having a hollow interior. A circuit board is mounted in the hollow interior of the body. A source of illumination is connected to the circuit board. A transparent cover extends across a lower end of the body. A mounting bracket assembly at an upper end of the body includes a base plate and a mounting bracket configured and dimensioned to allow mating in a predetermined axial alignment and locking upon subsequent relative rotation.

DETAILED DESCRIPTION

Figure 1:
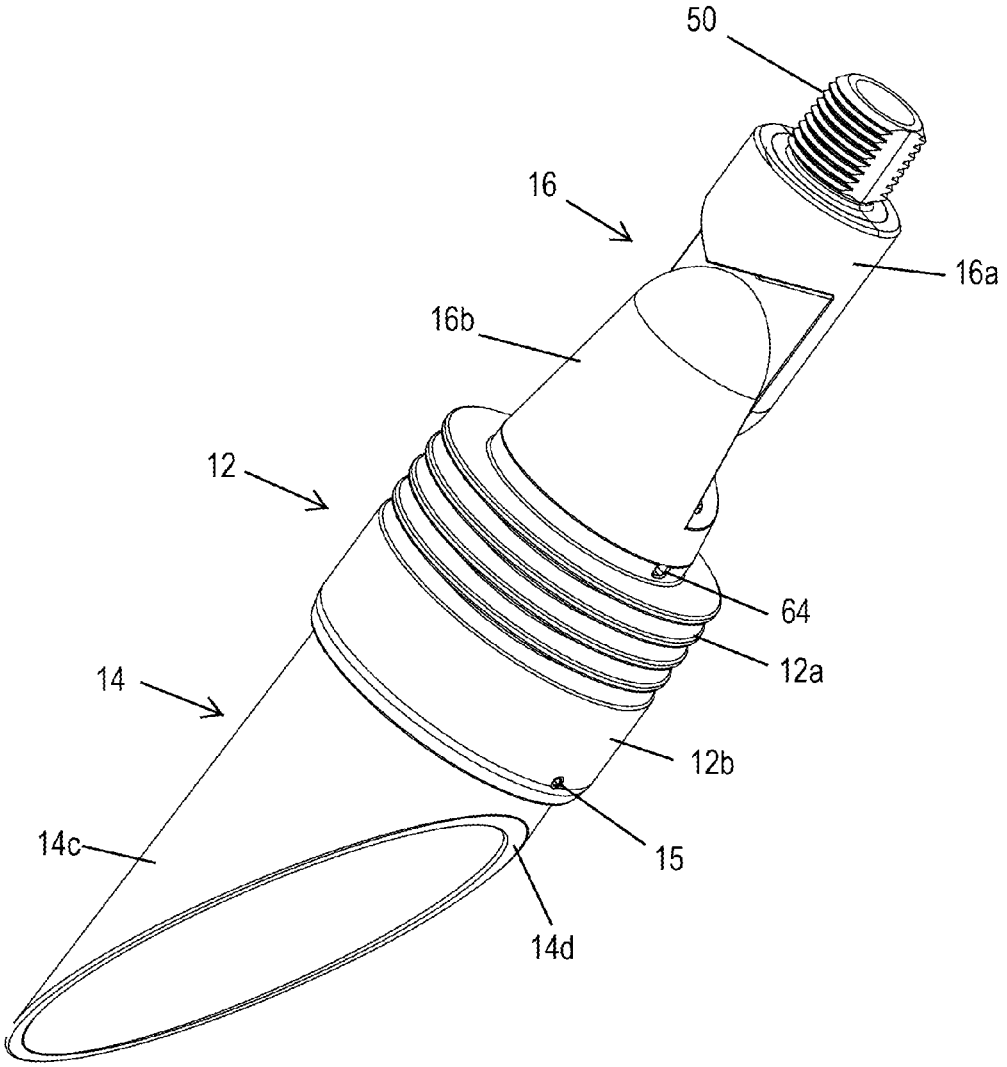
FIG. 1 is an isometric side elevation view of a down light fixture in accordance with an embodiment of the present invention.

FIG. 1 illustrates a down light fixture 10 in accordance with an embodiment of the present invention. The down light fixture 10 includes a cylindrical body 12 defining a hollow interior that encloses electrical components, a tapered shroud 14 slip fit and secured by a set screw 15 into a lower end of the cylindrical body 12 that directs and confines the emitted light, and a pivotable mounting device in the form of a knuckle joint assembly 16 attached to an upper end of the cylindrical body 12. The foregoing components are preferably machined from cast Aluminum alloy parts for durability. An anodized coating is preferably applied to the exterior of the machined Aluminum alloy parts to prevent oxidation and to provide an aesthetically appealing finish. These components can also be made of other suitable metals such as brass alloy, Aluminum, Copper, etc. Some or all of them can be molded out of suitable plastic; however, a material with high thermal conductivity is preferred for the cylindrical body 12 so that this component can facilitate the dissipation of heat generated by the source of illumination contained therein. An upper segment of the exterior of the cylindrical body 12 is provided with an integral heat sink in the form of a plurality of spaced-apart radially and circumferentially extending ribs 12*a*.

Figure 2:
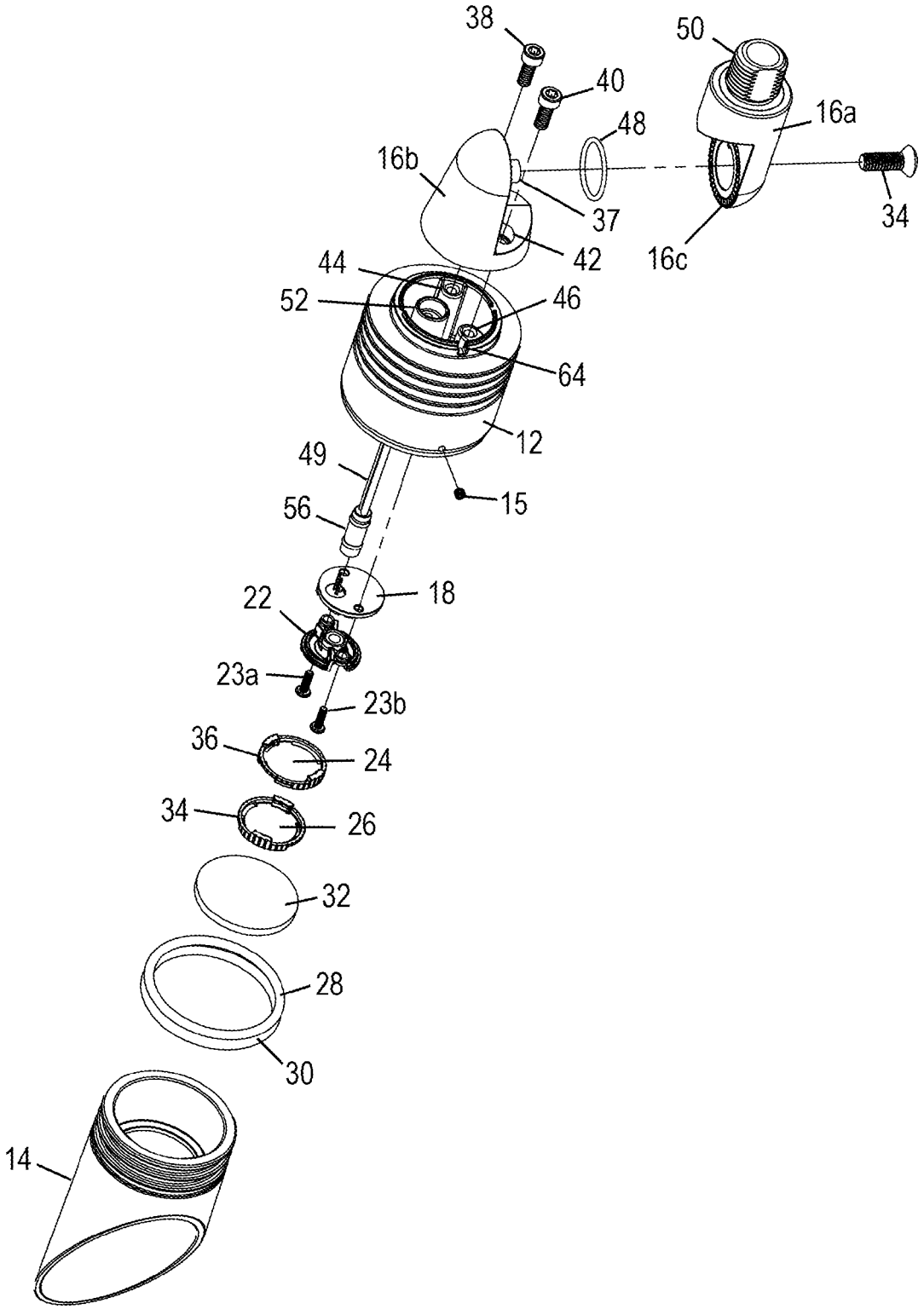
FIG. 2 is a slightly reduced, exploded isometric view of the down light fixture of FIG. 1.

Referring to FIG. 2, a disc-shaped LED luminary printed circuit board (PCB) 18 is mounted inside the cylindrical body 12. The luminary PCB 18 supports a high intensity LED 20 (FIG. 3) and provides a conductive path to the electrical power. The luminary PCB 18 is readily replaceable in the event of a failure of the LED 20. The down light fixture 10 may have a single LED and a PCB formed with electrically conductive paths for power connection and without other electronic components. Alternatively, the down light fixture 10 may be of the intelligent LED type disclosed in U.S. patent application Ser. No. 12/564,840 filed Sep. 22, 2009, by Peter J. Woytowitz entitled "Low Voltage Outdoor Lighting Power Source and Control System" and published Apr. 8, 2010, under Publication No. US-2010-0084985-A1, or U.S. Pat. No. 8,278,845 by Peter J. Woytowitz entitled "Systems and Methods for Providing Power and Data to Lighting Devices," the entire disclosures of which are hereby incorporated by reference. Said application and patent are assigned to Hunter Industries, Inc., the assignee of the subject application. The down light fixture 10 can have red, green and blue LEDs and can be connected to the aforementioned power source and control system in order to generate different lighting effects such as variable color and intensity in a reliable and energy efficient manner.

Figure 3:
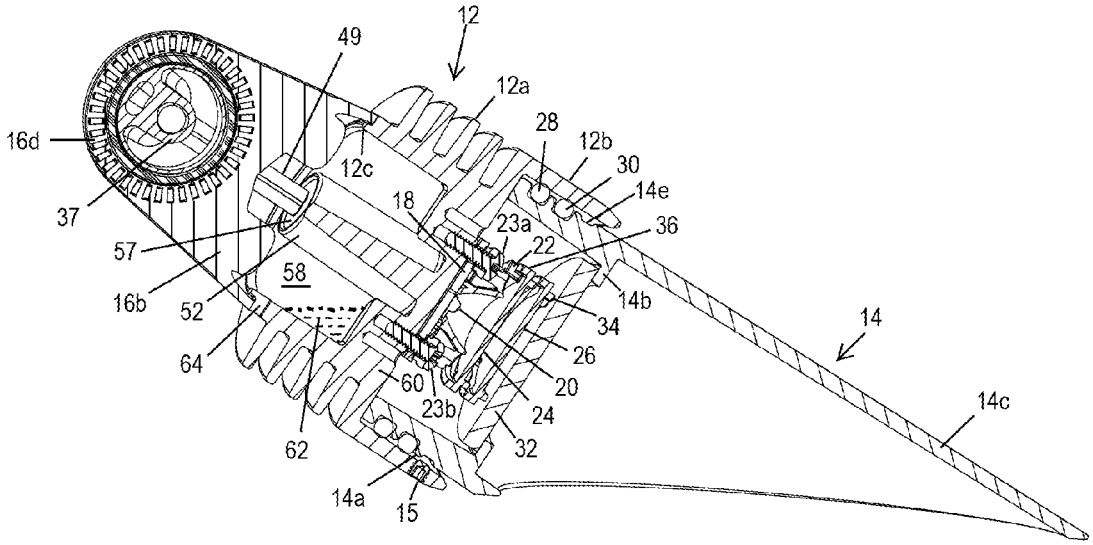
FIG. 3 is a longitudinal sectional view of the down light fixture of FIG. 1.

Referring still to FIG. 3, a parabolic reflector 22 surrounds the LED 20 so that the LED 20 is located at the approximate focus of the reflector 22 which gathers and forwardly directs the light emitted by the LED 20 in a predetermined desired pattern to the target area. The inner end of the reflector 22 is secured to the cylindrical body 12 with a pair of machine screws 23*a* and 23*b* (FIG. 2). The luminary PCB 18 is securely sandwiched between the reflector 22 and the cylindrical body 12 Referring to FIGS. 2 and 3, a disc-shaped color filter 24 and a disc-shaped diffuser 26 are mounted over the LED 20 and reflector 22. The diffuser 26 softens the intensity of the light emitted by the LED 20 as perceived by an observer's naked eye.

Figure 4:
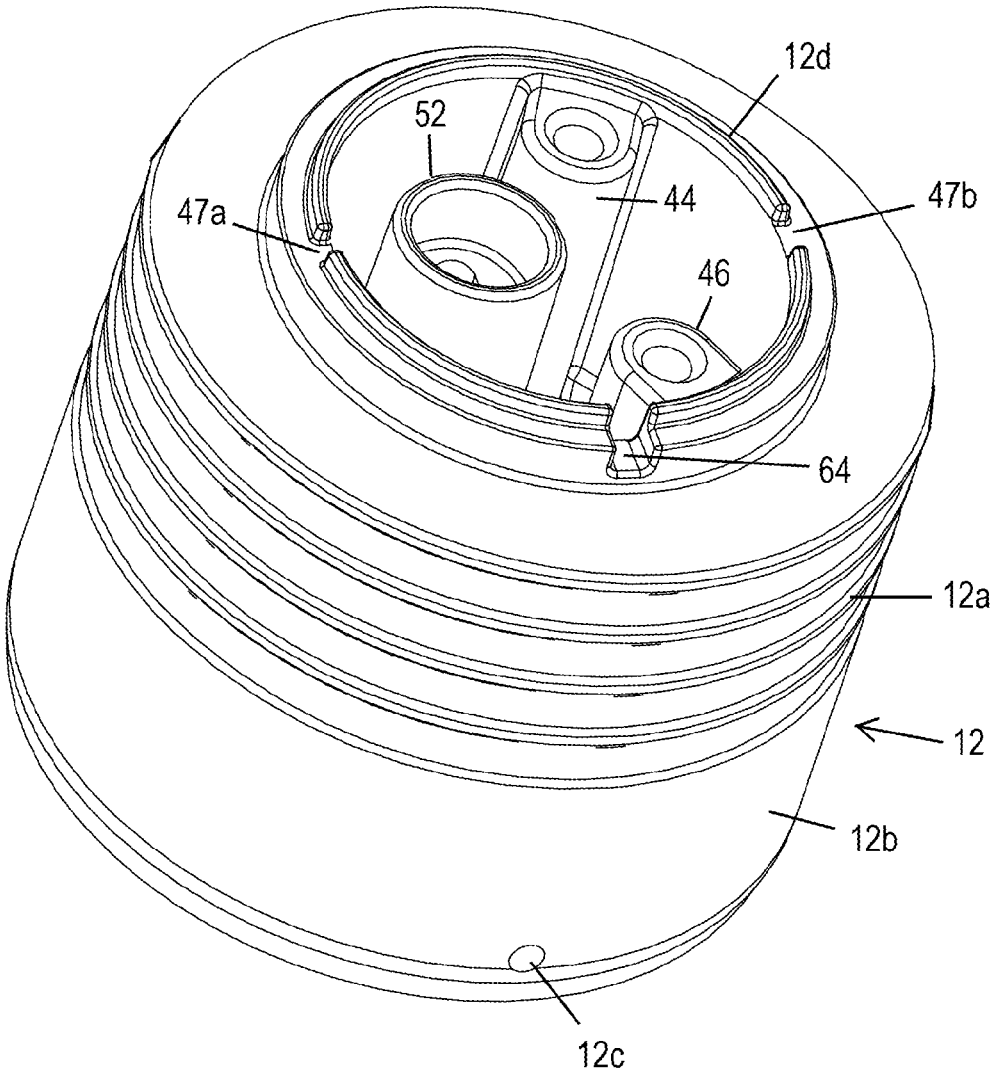
FIG. 4 is an enlarged isometric side elevation view of the cylindrical body of the down light fixture of FIG. 1 with its knuckle joint assembly removed.

An upper cylindrical segment 14*a* (FIG. 3) of the shroud 14 removably slips into the lower segment 12*b* of the cylindrical body 12. The female-to-male overlap of the lower body segment 12*b* with the upper cylindrical segment 14*a* of the shroud helps prevent entry of water into the cylindrical body 12. Additionally, entry of water into the cylindrical body 12 is further impeded by a pair of O-rings 28 and 30 made of a suitable elastomeric material that are seated in annular grooves formed in the exterior of the upper cylindrical segment 14*a* of the shroud 14 and are squeezed between the cylindrical body 12 and the shroud 14. The set screw 15 is threaded into a threaded hole 12*c* (FIG. 4) that is formed in the lower body segment 12*b* and is tightened against an annular groove 14*e* formed on the outer surface of upper cylindrical segment 14*a* to hold the shroud 14 securely in position both axially and radially.

A disc-shaped protective transparent cover 32 extends across the diffuser 26 and provides an optical path for light to leave the down light fixture 10. By way of example, the transparent cover 32 can be made of glass, high temperature resistant plastic, or scratch resistant sapphire. On one side of the transparent cover 32 a periphery of the transparent cover 32 engages the interior of a circular flange 14*b* that projects radially inwardly from the upper cylindrical segment 14*a* of the shroud 14. A circular frame 36 supports the color filter 24. The circular frame 36 carries the circular frame 34 and the diffuser 26. The circular frame 36 and the color filter 24 are in turn supported by the reflector 22. When the shroud 14 is screwed into the cylindrical body 12, the shroud 14, O-rings 28 and 30, and the transparent cover 32 seal off a lower portion of the hollow interior of the cylindrical body 12 and protect the luminary PCB 18 and the LED 20.

The knuckle joint assembly 16 (FIG. 1) includes a base knuckle 16*a* and a top knuckle 16*b* that are pivotally connected by a machine bolt 34 (FIG. 2). The male threaded distal end of the machine bolt 34 is screwed into a transversely extending female threaded sleeve 37 (FIG. 3) formed in the top knuckle 16*b* to pivotally connect the base knuckle 16*a* and the top knuckle 16*b*. The top knuckle 16*b* is secured to the upper end of the cylindrical base 12 with a pair of machine bolts 38 and 40 (FIG. 2) that pass through a pair of side-by-side bores 42 formed in the top knuckle 16*b*. The male threaded distal ends of the bolts 38 and 40 are screwed into axially extending female threaded sleeves 44 and 46 (FIG. 4) formed in the top of the cylindrical body 12.

The upper end of the cylindrical body 12 is formed with a circular mounting flange 12*d* (FIG. 4) which mates with a shoulder (not visible) of the top knuckle 16*b* as best seen in FIG. 3. A pair of diametrically opposed slots 47*a* and 47*b* formed in the mounting flange 12*d* receive corresponding projections (not illustrated) on the top knuckle 16*b* to rotationally align the top knuckle 16*b* and the cylindrical body 12 during assembly.

An O-ring 48 (FIG. 2) made of a suitable elastomeric material is seated in a pair of opposing circular grooves formed in the base knuckle 16*a* and the top knuckle 16*b*. The O-ring 48 helps to seal the knuckle joint assembly 16 against the unwanted intrusion of water. A plurality of radially extending teeth 16*c* formed in the circular face surface of the top knuckle 16*b* mate with and fit between a plurality of radially extending teeth 16*d* (FIG. 3) formed on the mating circular face of the base knuckle 16*a* to prevent unwanted slippage then the machine screw 34 is tightened. This arrangement permits the angle of the top knuckle 16*b* to be adjusted relative to the base knuckle 16*a* when the machine screw 34 has been loosened enough to allow the teeth 16*c* and 16*d* to pass by each other.

The base knuckle 16*a* and the top knuckle 16*b* are formed with recesses or grooves (not illustrated) that create a passageway. This passageway provides a conduit that allows a twin conductor insulated wire 49 (FIG. 2) to pass through a hollow male threaded shank 50 of the base knuckle 16*a* and through the top knuckle 16*b*. The wire 49 then passes through an axially extending cylindrical hollow potting cup 52 (FIG. 4) formed in the cylindrical base 12. The potting cup 52 is located inside the hollow interior of the cylindrical base 12 and provides a tubular conduit that extends between the knuckle joint assembly 16 and the luminary PCB 18. The passageway that extends through the base knuckle 16*a* and the top knuckle 16*b* is dimensioned and configured to allow the wire 49 to traverse the interior of the knuckle joint assembly 16 without binding or chafing while still allowing the knuckle joint assembly 16 to be pivotally adjusted to change the angle of illumination provided by the down light fixture 10. The proximal end of the wire 49 (not illustrated) extends a sufficient distance from the down light fixture 10 to facilitate operative connection of the conductors in the wires 49 to the terminals of the power source and control system. Additionally, the knuckle assembly 16 may be of the type found in U.S. Pat. No. 6,902,200 granted Jun. 7, 2005, to Joshua Beadle and entitled "Contaminant-Resistant Pivot Joint for Outdoor Lighting Fixture," the entire disclosure of which is hereby incorporated by reference. The aforementioned patent is also assigned to Hunter Industries, Inc.

The male threaded shank 50 (FIG. 2) of the knuckle joint assembly 16 can be screwed into a bracket (not illustrated) that can in turn be secured with wood screws or bolts to a beam or overhang of a building or to a structure such as a trellis or gazebo located in a lawn or garden. Typically the bracket would be secured to an overhead member so that the central longitudinal axes of the cylindrical base 12 and the shroud 14 are pointed in a downward direction. The down light fixture 10 can thus illuminate the target area below the down light fixture. The beveled lower portion 14*c* (FIG. 1) of the shroud 14 is preferably oriented so that a peripheral oval-shaped lip 14*d* thereof faces downwardly. In the preferred orientation, a plane that passes through the peripheral lip 14*d* is substantially perpendicular to a plane normal to the axis of rotation of the knuckle joint assembly 16 defined by the bolt 34 (FIG. 2). The set screw 15 (FIG. 3) fixes the rotational position of the shroud 14 relative to the cylindrical body 12 when it is tightened.

The luminary PCB 18 (FIGS. 2 and 3) has two conductive male pins made of metal that mate with corresponding metal contacts of a female electrical socket 56 (FIG. 2) operatively connected to the distal end of the wire 49. During assembly of the down light fixture 10 the wire 49 is potted inside the bore of the potting cup 52 with a predetermined quantity 57 of a suitable potting compound such as Part No. 041108-FC-4 from Ellsworth Adhesives. When the quantity of potting compound 57 cures, the potting compound 57 inside the potting cup 52 provides a substantially water tight seal between the wire 49 and an interior wall of the potting cup 52. The wire 49 is permanently potted and sealed in an effort to prevent water intrusion from the upper end of the cylindrical body 12 into the lower portion of the interior of the cylindrical body 12 where it might reach the luminary PCB 18, causing a short or damage to the LED 20. The upper portion of the hollow interior of the cylindrical body 12 includes a reservoir or cavity 58 (FIG. 3) through which the potting cup 52 extends. The cavity 58 is separated from the lower portion of the hollow interior of the cylindrical body 12 that contains the luminary PCB 18 by a transverse wall 60. The lower end of the potting cup 52 is integrally formed with the transverse wall 60 and the bore that extends through the potting cup 52 communicates with a hole formed in the transverse wall 60. This arrangement allows the electrical socket 56 to be pushed over the pair of metal pins that extend from the luminary PCB 18.

Due to the normal inclined orientation of the down light fixture 10 at a typical angle as illustrated in FIG. 3, a small quantity of water 62 can accumulate in the cavity 58. A slot 64 (FIG. 4) formed in the circular mounting flange 12*d* of the cylindrical body 12 provides a drain port. This drain port is rotationally oriented so that it is on the low side of the down light fixture 10. The upper end of the potting cup 52 is higher in reference to the longitudinal axis of the down light fixture 10 than the drain port. The size of the drain port is sufficient so that the water 62 will always drain out of the cylindrical body 12 via the drain port before it reaches the upper end of the quantity of potting compound 57. This prevents the water from standing on top of the potting compound 57 and seeping down through the potting cup 52 to the luminary PCB 18. This is true even if the down light fixture 10 is mounted with its longitudinal axis completely vertical.

Figure 5:
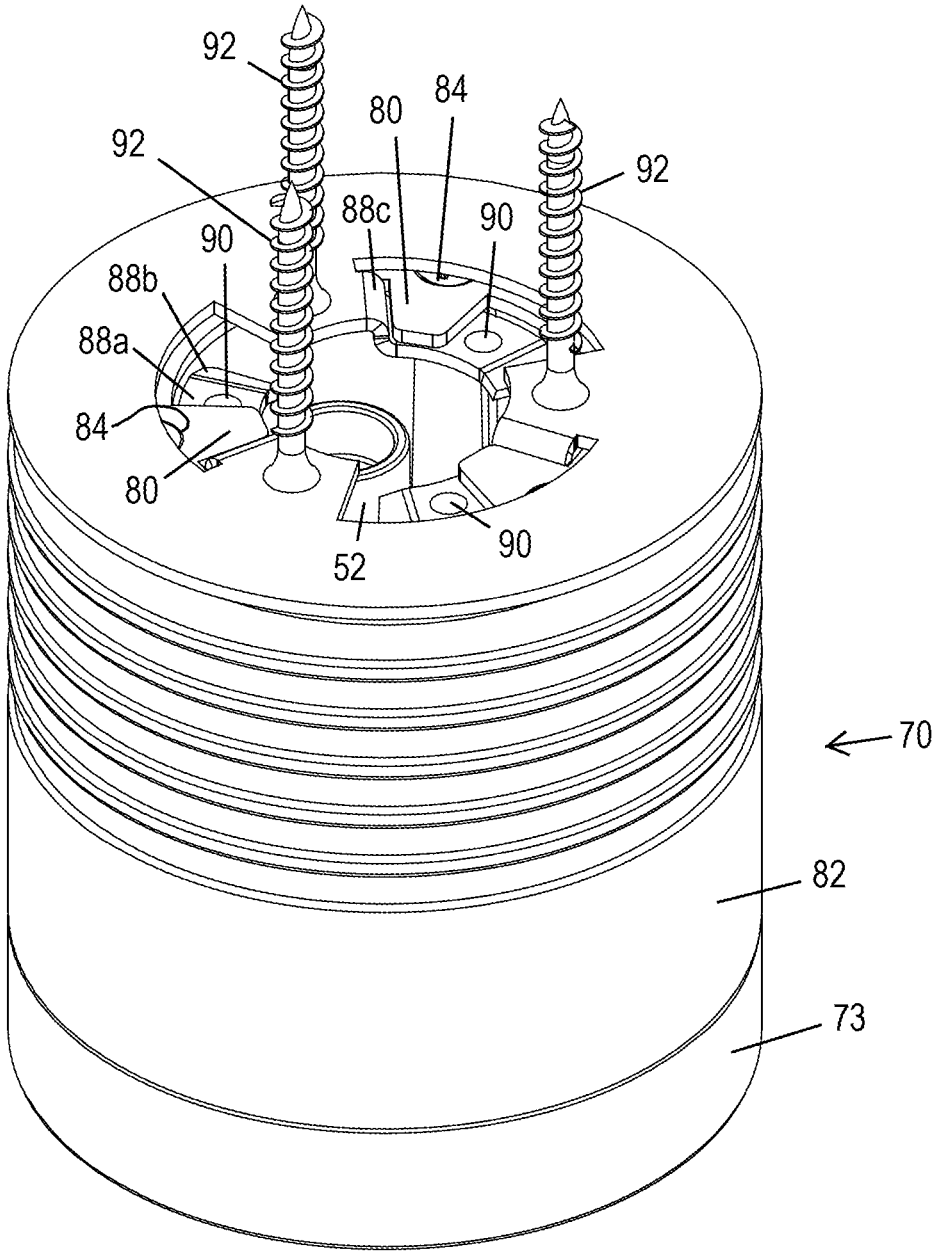
FIG. 5 is an isometric side elevation view of a light fixture in accordance with a second embodiment that includes a twist and lock mounting bracket assembly.
Figure 6:
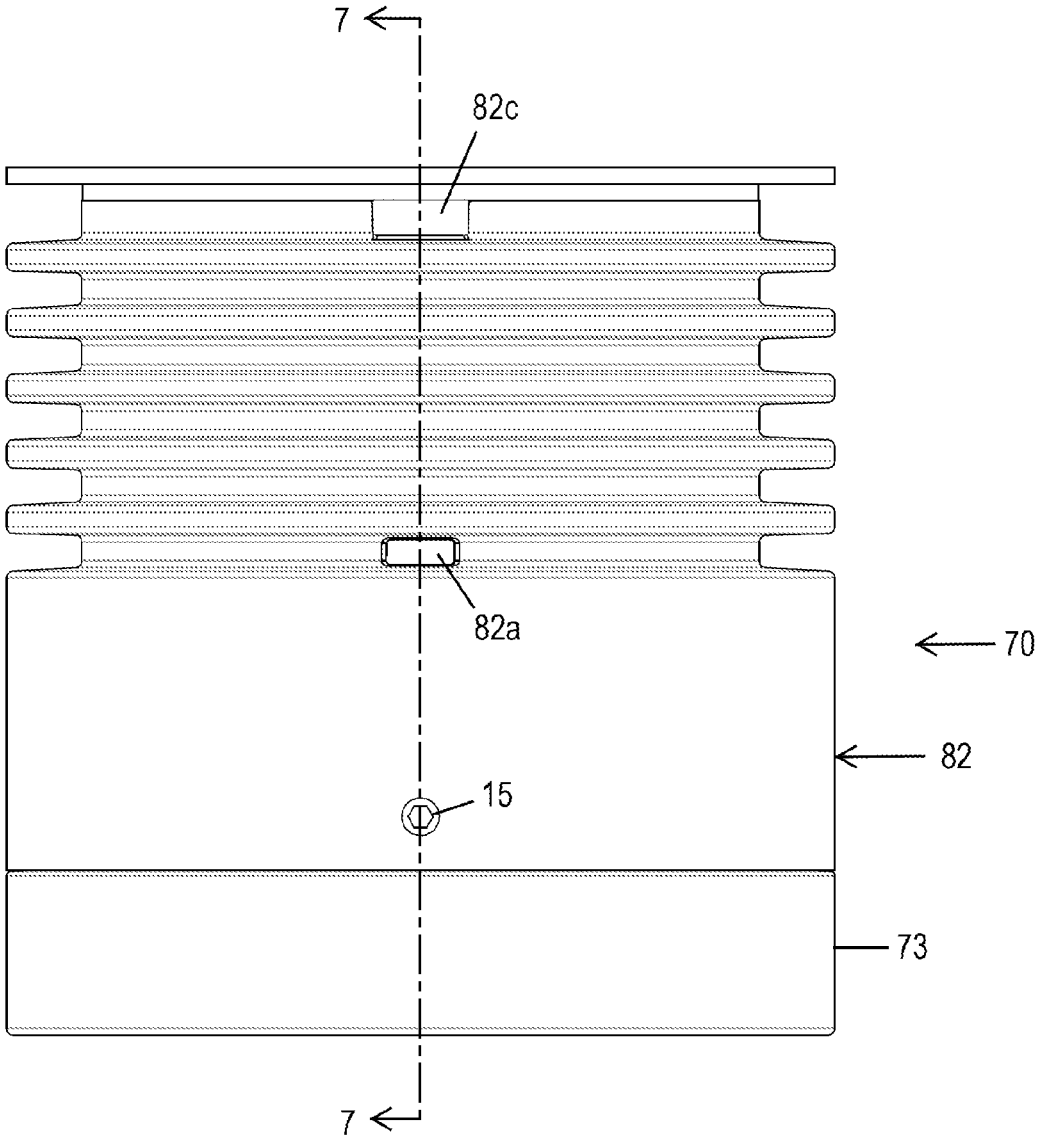
FIG. 6 is a side elevation view of the light fixture of FIG. 5.
Figure 7:
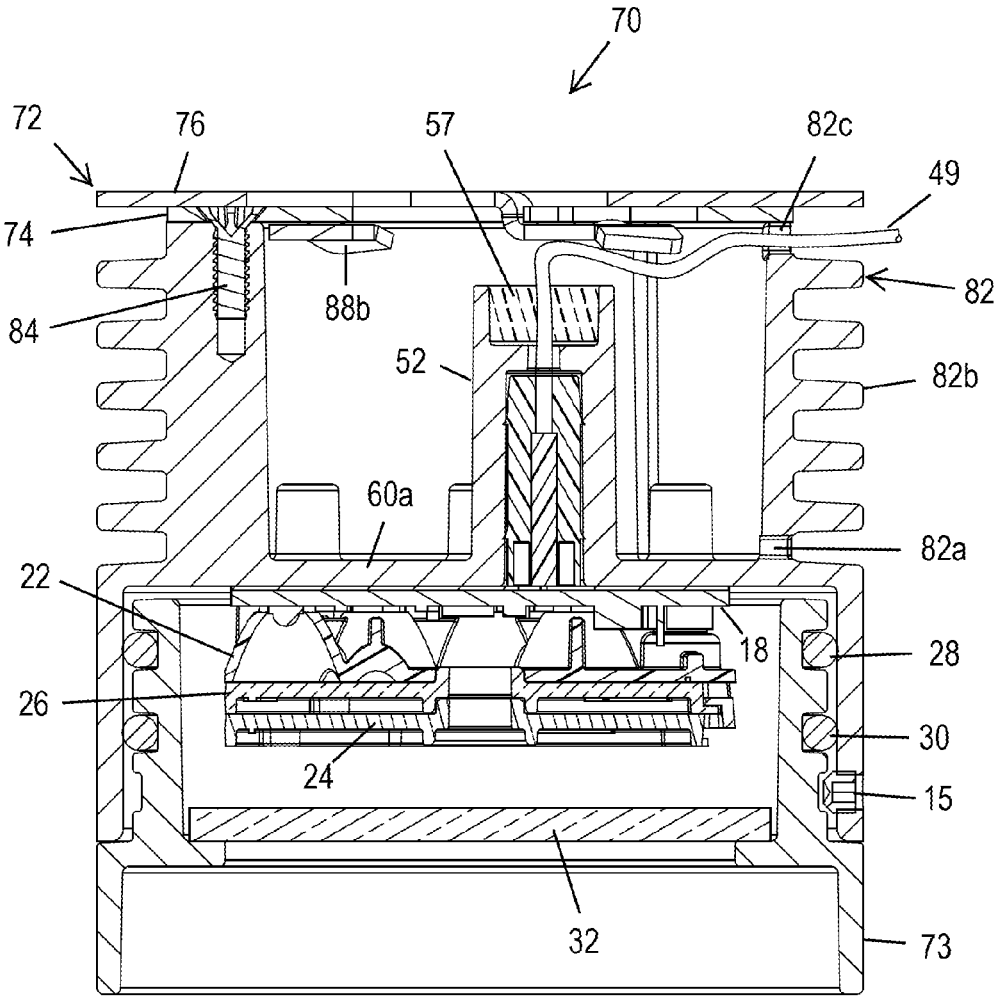
FIG. 7 is a vertical sectional view of the light fixture of FIGS. 5 and 6 taken along line 7-7 of FIG. 6. The insulated wire that is connected to the luminary printed circuit board (PCB) is illustrated in this sectional view.

Referring to FIGS. 5-7, a light fixture 70 in accordance with a second embodiment includes a twist and lock mounting bracket assembly generally denoted 72 in FIG. 7. The light fixture 70 has a construction similar to the down light fixture 10 except that the mounting bracket assembly 72 is used to mount the light fixture 70 to a building structure instead of the knuckle joint assembly 16. Also, the light fixture 70 includes a stepped cylindrical shroud 73 instead of the tapered shroud 14 of the down light fixture 10. Parts included in the light fixture 70 similar to those included in the down light fixture 10 are denoted by similar reference numerals in FIGS. 5-7.

Figure 8:
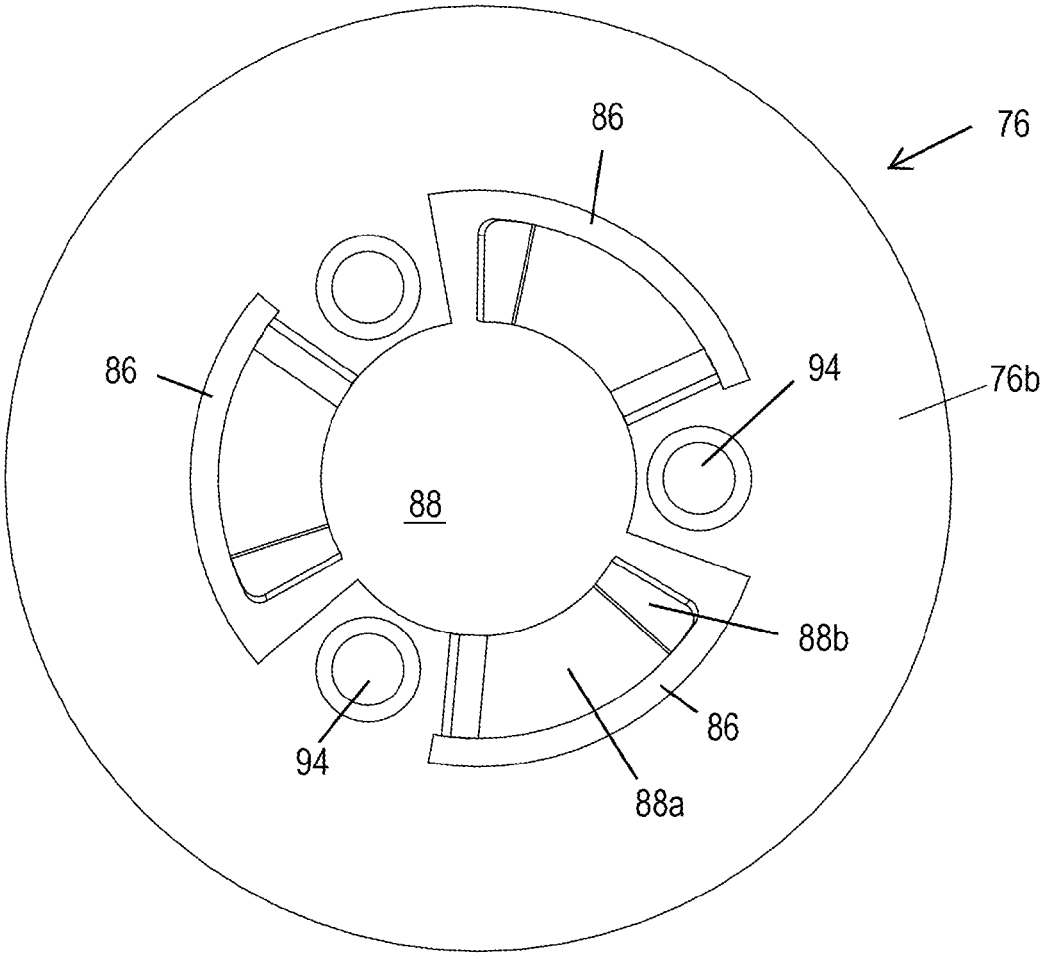
FIG. 8 is an enlarged bottom plan view of the mounting bracket of the light fixture of FIGS. 5 and 6.
Figure 12:
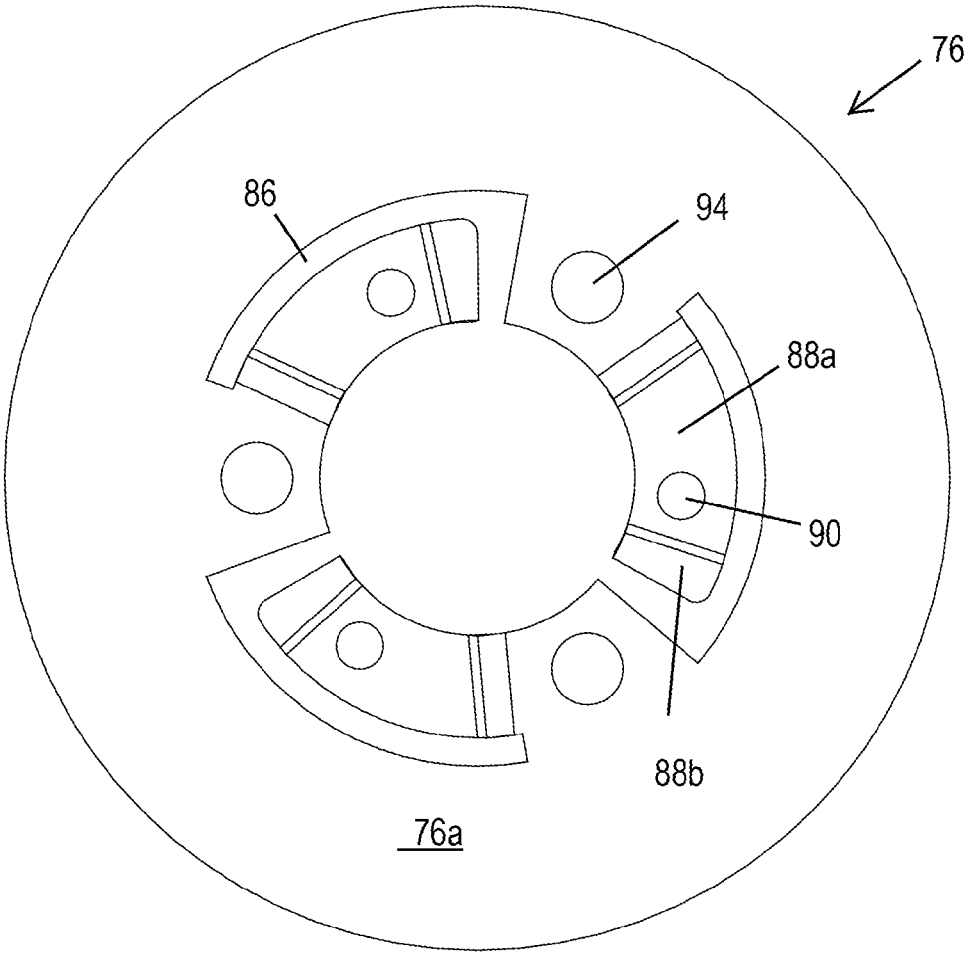
FIG. 12 is an enlarged bottom plan view of the mounting bracket assembly of the light fixture of FIGS. 5 and 6.
Figure 13:
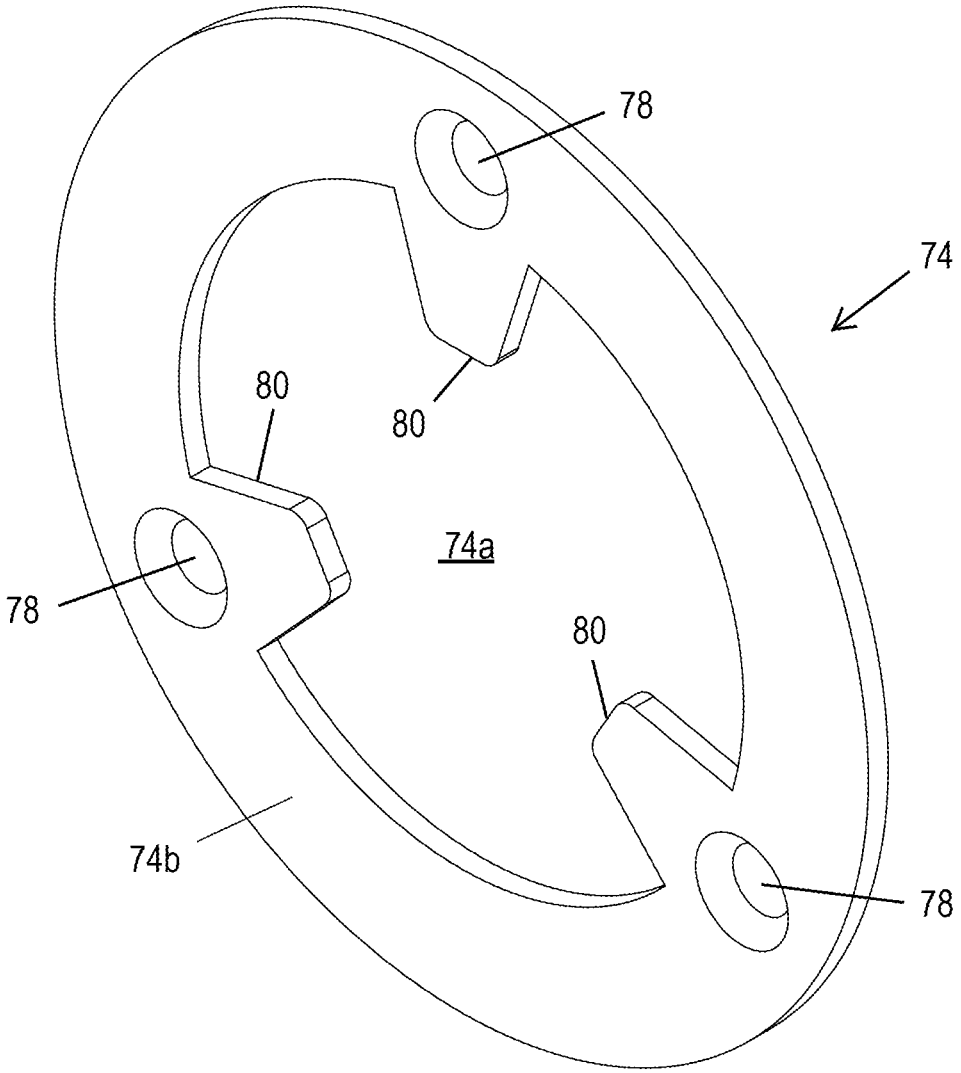
FIG. 13 is an enlarged isometric view of the base of mounting bracket assembly of the light fixture of FIGS. 5 and 6.

The mounting bracket assembly 72 includes a ring-shaped base plate 74 (FIG. 13) and a circular mounting bracket 76 (FIGS. 8, 9 and 12) that are configured so that they can be axially mated, and then twisted relative to one another to lock them together. Referring again to FIG. 13, the base plate 74 has three counter-sunk mounting holes 78 each formed adjacent one of three corresponding generally triangular tabs 80 that are equally circumferentially spaced one hundred and twenty degrees apart. The base plate 74 has a large central aperture 74*a* (FIG. 13) into which the triangular tabs 80 extend in a radial direction. As best seen in FIG. 7, the base plate 74 overlaps the upper end of an upper cylindrical body 82 and has approximately the same outer diameter.

The hollow interior of the cylindrical body 82 contains the potting cup 52 (FIG. 7). The hollow interior of the cylindrical shroud 73 contains the luminary PCB 18, color filter 24, diffuser 26, and a plurality of parabolic reflectors 22 that surround corresponding LEDs. The combination of the cylindrical shroud 73 and the cylindrical body 82 defines a larger generally cylindrical body having a hollow interior that is divided by transverse wall 60*a*. The transparent cover 32 extends across the lower end of the cylindrical shroud 73.

The cylindrical body 82 has a drain port 82*a* (FIGS. 6 and 7) that is formed therein below the ribbed heat sink segment 82*b* of the cylindrical body. The wire 49 from the luminary PCB 18 can be routed through an aperture 82*c* (FIG. 7) formed in the side of the cylindrical body 82. Alternatively, the wiring can also be routed through the open areas of the mounting brackets 74 and 76 if this better fits the installation. Three machine screws such as 84 extend through corresponding mounting holes 78 in the base plate 74 and are screwed into corresponding axially extending female threaded bores in the upper end of the cylindrical body 82. This firmly secures the base plate 74 to the cylindrical body 82.

The mounting bracket 76 (FIG. 8) is specially configured to permit axial mating with the base plate 74, i.e. movement along the central cylindrical axis of the cylindrical body 82, when the triangular tabs 80 on the base plate 74 are aligned with three corresponding arcuate apertures 86 formed in the mounting bracket 76. The mounting bracket 76 is separable from the base plate 74 and the cylindrical body 82 by reversing the steps of their mating coupling and locking. The arcuate apertures 86 are equally circumferentially spaced about the middle radial region of the disc-shaped mounting bracket 76. Three arcuately curved holding fingers 88 (FIG. 9) are formed on the mounting bracket 76. The arcuate apertures 86 and the holding fingers 88 have a complementary curvature. This allows the holding fingers 88 to extend within corresponding ones of the arcuate apertures 86. The mounting bracket 76 can be stamped from suitable metal, simultaneously forming the arcuate apertures 86 and the holding fingers 88 or it may be formed from other suitable materials including injection molded thermo plastic.

Figure 9:
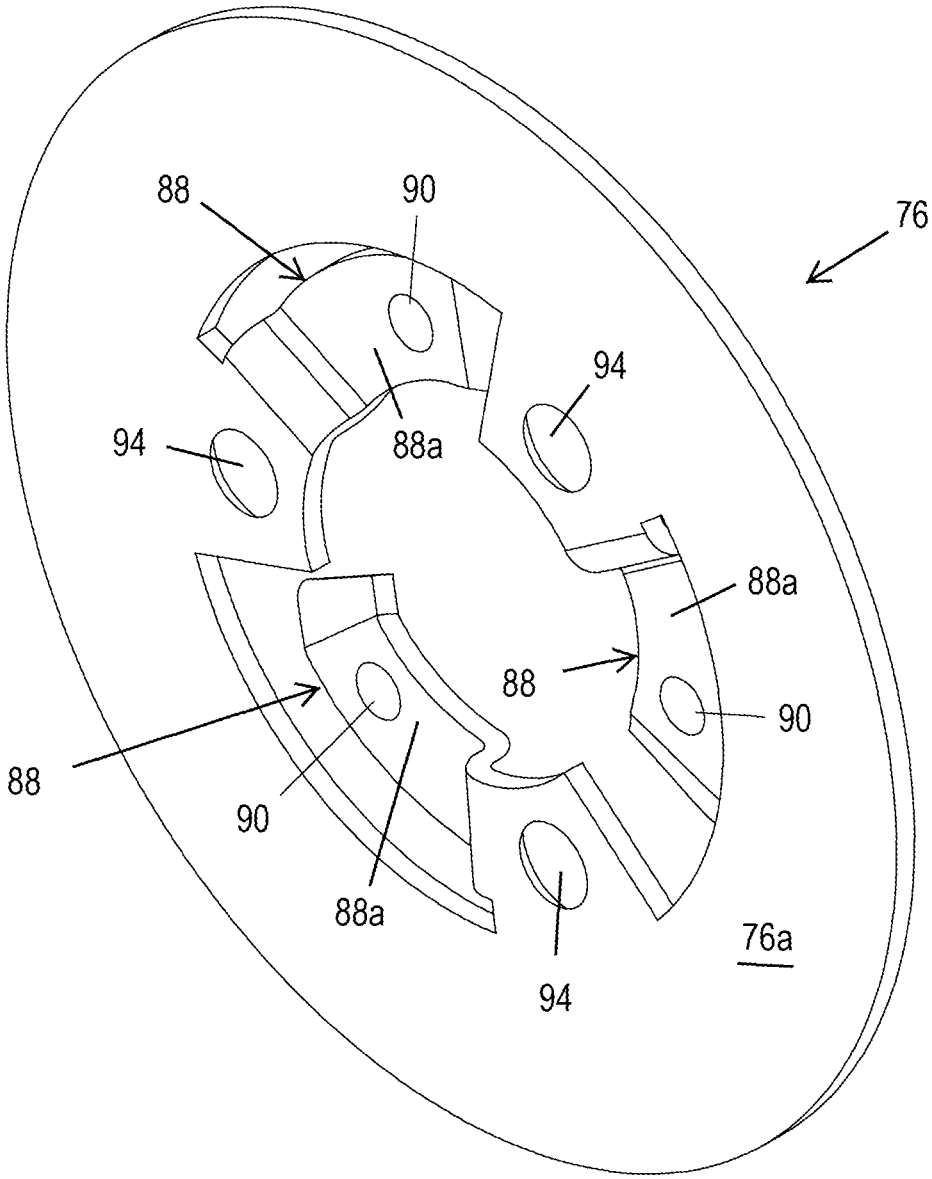
FIG. 9 is an enlarged isometric view of the mounting bracket of the light fixture of FIGS. 5 and 6 taken from the top side thereof.
Figure 10:
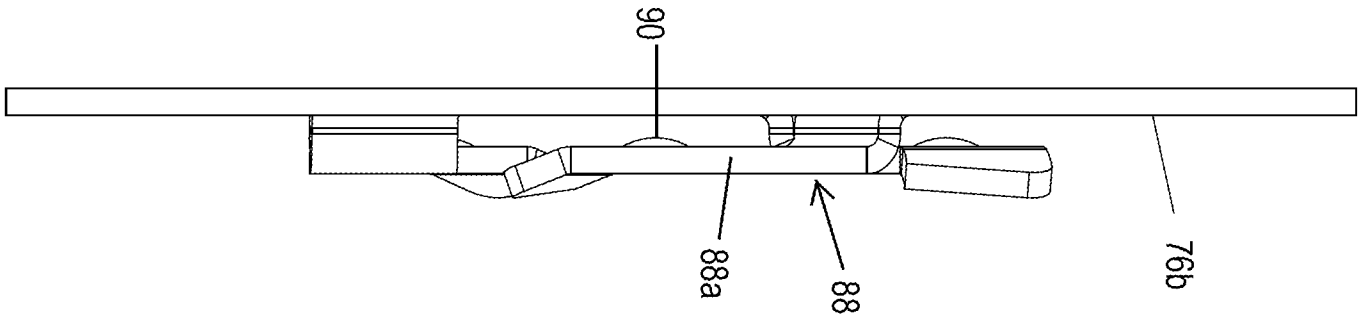
FIG. 10 is an enlarged side elevation view of the mounting bracket of the light fixture of FIGS. 5 and 6.
Figure 11:
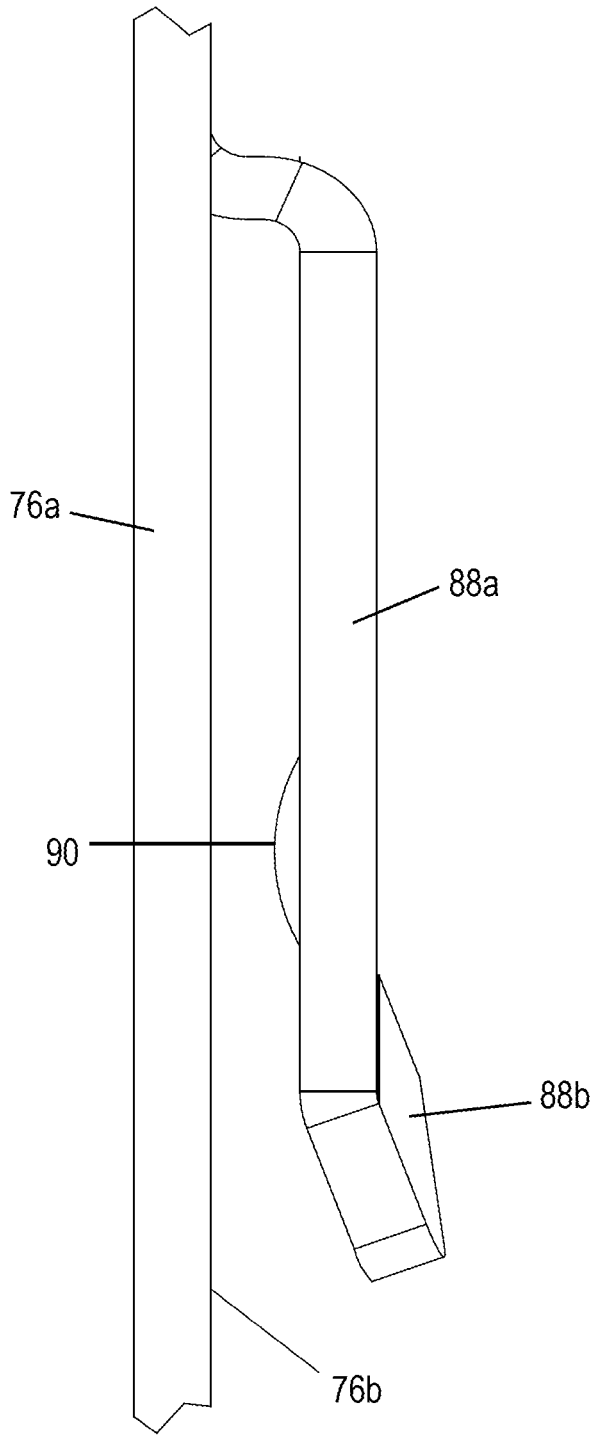
FIG. 11 is an enlarged fragmentary portion of FIG. 10 showing details of its holding finger.

As best seen in FIGS. 9-11, the holding fingers 88 have main planar portions 88*a* that are axially displaced, i.e. offset from, and extend parallel to, the planar main disc portion 76*a* of the mounting bracket 76. The main portions 88*a* of the holding fingers 88 have a spring resilience, i.e. they can flex away from the main disc portion 76*a* when they are pushed against by the triangular tabs 80. The distal ends 88*b* of the holding fingers 88 are bent or tapered away from the main disc portion 76*a* of the mounting bracket 76 to facilitate the twist and lock mating of the base plate 74 with the mounting bracket 76 as hereafter described.

When the mounting bracket 76 is axially aligned with base plate 74, and surface 76*b* is in contact with the surface 74*b* of the base plate 74, the triangular tabs 80 can be positioned in corresponding ones of the arcuate apertures 86 to engage the distal ends 88*b* of corresponding ones of the holding fingers 88. The cylindrical body 82 can then be rotated about its central axis, deflecting the main portions 88*a* of the holding fingers 88, until the triangular tabs 80 ride over and past retaining bumps 90 (FIGS. 9, 10 and 11) formed on each of the holding fingers 88. Once the triangular tabs 80 move past their corresponding retaining bumps 90 the spring resilience of the main portions 88*a* of the holding fingers 88 causes them to move back axially toward the main disc portion 76*a*, locking the light fixture 70 relative to the mounting bracket 76. The triangular tabs 80 cannot be pulled axially away from the holding fingers 88, and therefore, the light fixture 70 will be removably secured to the wooden beam or other building structure (not illustrated) to which the mounting bracket 76 has been secured with screws 92.

As best seen in FIG. 5, further counter-clockwise rotation of the light fixture 70 relative to the base plate 74 in FIG. 5 is prevented by engagement of the triangular tabs 80 with the inner shoulders 88*c* of the respective holding fingers 88 which functions as rotational stops or movement limiting devices. The shoulders 88*c* of the holding fingers 88 limit the amount of angular displacement between the base plate 74 and the mounting bracket 76. The retaining bumps 90 prevent undesired inadvertent unlocking of the mounting bracket 76 from the light fixture 70 unless a predetermined minimum torque is applied to the mounting bracket. The predetermined minimum amount of torque is determined by the height of the retaining bumps 90 and spring force of the holding fingers 88 which function as leaf springs. This spring force is determined by the dimensions, configuration and modulus elasticity of the material from which the mounting bracket 76 is formed. Other structures besides the retaining bumps 90 could be used to achieve a positive locking action such as various detents and projections formed on the triangular tabs 80 and the holding fingers 82.

During installation, as a single piece separate and apart from the remainder of the light fixture 70, the mounting bracket 76 is first secured to a wooden building structure with three wood screws 92 (FIG. 5). The wood screws 92 are inserted through corresponding counter-sunk holes 94 (FIG. 12) formed in the main disc portion 76*a* of the mounting bracket 76. The light fixture 70 is then rotationally aligned with the mounting bracket 76 so that the light fixture 70 can be moved axially until surface 76*b* of mounting bracket 76 contacts the surface 74*b* of the base plate 74. The light fixture 70 can then be twisted so the triangular tabs 80 slide past the bent distal ends 88*b* and under the holding fingers 88 and past the retaining bumps 90 to lock it to the mounting bracket 76. If it should be necessary to repair or replace the light fixture 70 it can be readily detached from the mounting bracket 76 by a manual reverse twist and unlock operation.

While two embodiments of light fixtures have been described in detail, it will be understood by those skilled in the art, based on the description herein, that these light fixtures can be modified in both arrangement and detail. For example, the source of illumination could be an incandescent bulb instead of an LED. See U.S. Pat. No. 6,784,905 granted Apr. 5, 2005, to Joshua Z. Beadle or U.S. Pat. No. 7,387,409 granted Jun. 17, 2008, to Joshua Z. Beadle, the entire disclosures of which are hereby incorporated by reference. Said patents are also assigned to Hunter Industries, Inc. The down light fixture 10 could be designed to work with the lighting controller disclosed in pending U.S. patent application Ser. No. 13/189,718 filed on Jul. 25, 2011, by Peter J. Woytowitz entitled "Programmable Landscape Lighting Controller with Self-Diagnostic Capabilities and Fail Safe Features," the entire disclosure of which is hereby incorporated by reference. Said application is also assigned to Hunter Industries, Inc. In regard to the embodiment of FIGS. 5-13, the features of the base plate 74 could be formed as an integral parts of the cylindrical body 82. As another alternative, the mounting bracket 76 could be secured to the cylindrical body 82 and the mounting plate 74 could be screwed to the building structure. Therefore, the protection afforded the present invention should only be limited in accordance with the scope of the following claims.

What is claimed is:

1. A light fixture for installation on building structures and on other structures located around lawns and gardens of residential and commercial properties, comprising:

a body having a hollow interior;

a source of illumination positioned within the hollow interior;

a transparent cover that extends across a lower end of the body; and a mounting bracket assembly at an upper end of the body including a first separable portion and a second separable portion, the first and second separable portions configured and dimensioned to allow mating in a predetermined axial alignment and locking upon subsequent relative rotation;

the first separable portion includes a plurality of radially extending tabs; and the second separable portion includes a plurality of arcuate apertures and plurality of resilient holding fingers extending within the arcuate apertures;

wherein the holding fingers are configured to deflect when engaged with the tabs when the first separable portion is rotated into engagement with the second separable portion.

2. The light fixture of claim 1 wherein the holding fingers each have a retaining bump, past which each corresponding tab slides, that prevents unlocking of one of the first and second separable portions, unless a predetermined minimum torque is applied to one of the first and second separable portions.

3. The light fixture of claim 1 wherein each of the holding fingers has a tapered distal end.

4. The light fixture of claim 1 wherein each of the holding fingers has a rotational stop to limit the amount of angular displacement between the first separable portion and the second separable portion.

5. The light fixture of claim 1 wherein the body is cylindrical and is comprised of an upper body portion and a lower shroud.

6. A light fixture, comprising:

a body having a hollow interior, the body having a plurality of circumferentially spaced, radially extending tabs;

a source of illumination mounted inside the body;

a transparent cover mounted on one end of the body; and a mounting bracket at an upper end of the body configured and dimensioned to allow mating of the mounting bracket to the body in a predetermined axial alignment and locking upon subsequent rotation relative to the body, the mounting bracket having a plurality of circumferentially extending holding fingers being dimensioned and configured to be flexible and resilient, and to deflect when the fingers are engaged with the tabs of the body and the mounting bracket is rotated relative to the body;

wherein the mounting bracket is formed with a plurality of arcuate shaped apertures and the holding fingers are curved and extend within corresponding ones of the arcuate shaped apertures.

7. The light fixture of claim 6 wherein the holding fingers each have a retaining bump past which each corresponding tab slides that prevents unlocking of the mounting bracket unless a predetermined minimum torque is applied to the mounting bracket.

8. The light fixture of claim 6 wherein the holding fingers each have a tapered distal end.

9. The light fixture of claim 6 wherein the body is cylindrical and is comprised of at least an upper body portion and a lower shroud.

10. The light fixture of claim 6 wherein the radially extending tabs are formed on a base plate that is attached to the body, the base plate having a ring shape and a central aperture into which the tabs project in radial fashion.

11. The light fixture of claim 10 wherein the base plate is secured to the upper end of the body and the mounting bracket has a plurality of mounting holes for screws to extend thereto for securing the mounting bracket to a building structure.

12. The light fixture of claim 10 wherein each of the holding fingers has a rotational stop to limit the amount of angular displacement between the base plate and the mounting bracket.

13. The light fixture of claim 12 wherein the rotational stops are shoulders of the holding fingers.

14. A light fixture for installation on building structures and on other structures located around lawns and gardens of residential and commercial properties, comprising:

a body having a hollow interior;

a circuit board mounted in the hollow interior of the body;

a source of illumination connected to the circuit board;

a transparent cover that extends across a lower end of the body; and a mounting bracket assembly at an upper end of the body including a base plate and a mounting bracket configured and dimensioned to allow mating in a predetermined axial alignment and locking upon subsequent relative rotation the base plate, the base plate having a plurality of circumferentially spaced, radially extending tabs that engage corresponding ones of a plurality of circumferentially spaced holding fingers on the mounting bracket, the holding fingers being dimensioned and configured to be flexible and resilient and to deflect when the mounting bracket is rotated relative to the base plate, base plate being ring shaped and having a central aperture into which the tabs project, the mounting bracket being formed with a plurality of arcuate shaped apertures, and the holding fingers being curved and extending within corresponding ones of the arcuate shaped apertures.

* * * * *